United States Patent [19]

Sigl et al.

[11] Patent Number: 4,638,921

[45] Date of Patent: Jan. 27, 1987

[54] DEVICE FOR DISPENSING INDIVIDUAL SHEETS FROM AN ARRAY OF STACKED SHEETS

[75] Inventors: Wayne C. Sigl, Neenah; Elizabeth A. Wolfson, Menasha, both of Wis.

[73] Assignee: Kimberly-Clark Corporation, Neenah, Wis.

[21] Appl. No.: 786,892

[22] Filed: Oct. 11, 1985

Related U.S. Application Data

[63] Continuation-in-part of Ser. No. 776,554, Sep. 16, 1985, abandoned.

[51] Int. Cl.[4] ..... A47K 10/20; B65H 3/00

[52] U.S. Cl. ..... 221/1; 221/48; 221/63

[58] Field of Search ..... 221/45–55, 221/61, 63, 33, 34, 35, 1; 206/812

[56] References Cited

U.S. PATENT DOCUMENTS

| | | | |
|---|---|---|---|
| 1,525,040 | 2/1925 | Painter | 221/63 X |
| 1,706,220 | 3/1929 | Fairchild | 221/48 |
| 3,780,908 | 12/1973 | Fitzpatrick et al. | 221/48 |
| 3,784,056 | 1/1974 | Spruyt et al. | 221/63 |
| 3,836,044 | 9/1974 | Tilp et al. | 221/55 |
| 3,893,566 | 7/1975 | Ross | 206/498 |
| 3,970,215 | 7/1976 | McLaren et al. | 221/45 |
| 3,994,417 | 11/1976 | Boedecker | 221/48 |
| 4,017,002 | 4/1977 | Doyle et al. | 221/63 |
| 4,138,034 | 2/1979 | McCarthy | 221/48 |
| 4,221,304 | 9/1980 | Wahl et al. | 221/1 |

FOREIGN PATENT DOCUMENTS

| | | | |
|---|---|---|---|
| 19238 | of 1907 | United Kingdom | 221/63 |

*Primary Examiner*—F. J. Bartuska
*Attorney, Agent, or Firm*—Paul Yee

[57] ABSTRACT

The present invention provides an improved apparatus for sequentially dispensing individual, liquid-impregnated sheets along a dispensing direction from an interfolded array of the sheets while presenting a next available sheet from the array in a graspable position. The apparatus includes a container for holding the array of sheets and includes a distinctive guiding mechanism. The guiding mechanism is located on the container and extends substantially linearly along a direction transverse to the dispensing direction. It contacts a major surface of an overlapped portion between a preceding sheet and a successive sheet, and directs the sheets along a curvilinear path, which curves in a direction substantially perpendicular to the sheet surface. This configuration induces a separation between the individual sheets and presents a portion of the successive sheet in a graspable position outside of the container.

17 Claims, 23 Drawing Figures

DEVICE FOR DISPENSING INDIVIDUAL SHEETS FROM AN ARRAY OF STACKED SHEETS

CROSS REFERENCE TO RELATED CASES

This is a continuation-in-part of co-pending and commonly assigned U.S. patent application Ser. No. 776,554 filed Sept. 16, 1985 now abandoned and entitled "Dispensing Package for a Stacked Array of Sheets."

1. Field of the Invention

The present invention pertains to a device for dispensing individual sheets from an interfolded array of the sheets. More specifically, the invention is related to a device for dispensing an individual liquid-impregnated sheet from an interfolded, stacked array of the sheets and then presenting a next available sheet from the array into a graspable, dispensing position.

2. Background of the Invention

In recent years a variety of dispensing packages has been employed for dispensing sheets, such as tissue, towelettes, nonwoven cloths, napkins and the like. The dispensed sheet article is impregnated or at least partially saturated with selected fluids or solids, such as perfumes, antiseptic solutions, waxes, polishes, deodorants, cleaning solutions, scouring compounds and the like. Such dispensing packages have employed various approaches for dispensing the sheet article in a "pop-up/pop-out" fashion, wherein a stacked array of the sheet articles is dispensed such that the withdrawal of a single presented sheet from the package carries a next successive sheet in the array into a dispensing position.

One type of dispensing container is constructed to deliver a continuous series of sheets through a small, slit type orifice located at the top of the container. A dispenser of this type is described in U.S. Pat. No. 4,017,002 issued Apr. 12, 1977 to R. Doyle, et al. A continuous string of sheets is delivered from a common roll, the string is perforated at points along its length to assist the user in tearing off an individual sheet once it is fully delivered through the orifice. Such systems can be unreliable because more than one sheet can be accidentally pulled through the orifice when the user attempts to tear off an individual sheet.

A similar type of dispenser can be employed to dispense premoistened sheets from an interfolded, interleaved stack of sheets. Such dispensing devices are described in U.S. Pat. No. 4,138,034 issued Feb. 6, 1979 to R. McCarthy; U.S. Pat. No. 3,994,417 issued Nov. 30, 1976 to S. Boedecker; and U.S. Pat. No. 4,221,304 issued Sept. 9, 1980 to K. Wahl, et al. These devices employ restricted, slit-type orifices or shaped holes sized to permit the passage therethrough of one or two of the premoistened sheets. As each sheet is pulled through the orifice, a sufficient amount of the next available sheet is also pulled through to allow a convenient grasping by the user when desired.

Dispensing packages which employ small, restricted orifices have typically delivered the premoistened sheet in a wrinkled or gathered condition. As a result, the sheet can be self-adhered to itself over a significant portion of its surface area. The task of straightening or unfolding the sheet to present a generally flat surface for use can be difficult. The self-adhered condition of the sheet is particularly disadvantageous where the sheets are baby wipes which must be quickly and one-handedly opened into an extended condition after withdrawal from the container.

U.S. Pat. No. 3,780,908 issued Dec. 25, 1973 to W. Fitzpatrick and U.S. Pat. No. 3,836,044 issued Sept. 17, 1974 to R. Tilp each discloses a package for dispensing individual, wet sheets from a stack. The dispensing package includes a container with a cover which closes to provide a substantially moisture-proof seal between the container and the atmosphere. A barrier member, which overlies the stack of wet sheets and is interposed between the stack and the cover, has a sheet-restricting opening therein through which the wet sheets may be individually and successively withdrawn from the package. The drawings of these patents show that the dispensing opening in the barrier member is quite large relative to the surface area of the underlying sheet. As a result, a significant amount of moisture can evaporate from the stack array, particularly from the upper most sheets, when the container is open.

In addition, as disclosed in these patents, the container is provided in the form of a box-shaped member prepared for example by molding or vacuum forming of a suitable plastic such as polypropylene, with the cover of the container being hingedly joined to the rear wall of the container body. In such construction the cover has a tendency to close during use, providing the aforementioned difficulties, as associated with the dispensing opening being centrally disposed in the barrier member of the container.

U.S. Pat. No. 3,784,056 issued Jan. 8, 1974 to H. Spruyt, et al. and U.S. Pat. 3,970,215 issued July 20, 1976 to E. McLaren, et al. each disclose a dispensing package which includes a slit type opening with overlapping side flaps. The overlapping flaps reduce the amount of moisture evaporation from the container. The dispensing packages taught by these references, however, do not provide a "pop-up" presentation of the next successive sheet within the container.

Conventional dispensing devices, such as those discussed above, have not been able to provide a mechanism which reliably dispenses one sheet at a time while also presenting a next successive sheet in a graspable position outside of the dispensing container. The individual sheets often do not separate from each other and are dispensed presented in a gathered or crumpled condition. Since the moisture in the sheet increases its self-adherence, the sheet can then be difficult to spread back out with a one handed operation.

SUMMARY OF THE INVENTION

The present invention provides an improved apparatus for sequentially dispensing individual, liquid-impregnated sheets along a dispensing direction from an interfolded array of the sheets while presenting a next available sheet from the array in a graspable position. Generally stated, the apparatus includes a container for holding the array of sheets, and a guiding means located on the container. The guiding means, which extends substantially linearly along a direction transverse to the dispensing direction, contacts a major surface of the sheets and directs the sheets along a curvilinear path which curves in a direction substantially perpendicular to the sheet surface. The guiding means thereby induces a separation between the individual sheets and presents a portion of the next available sheet in a graspable position outside of the container.

A particular aspect of the invention relates to a dispensing package for an array of sheets dispensable so that withdrawal of a single presented sheet from the package will cause it to carry a next successive sheet in the array into dispensing position, comprising:

A container having a floor and defining an enclosed volume for retention of the array of sheets therein, and including closure means moveable between an open position to define a dispenser opening and a closed position; and A shelf member mounted on the container within the enclosed volume of the container in vertically spaced relationship to the floor and terminating in a front edge disposed in spaced facing relationship to the dispenser opening, thereby enabling sequential withdrawing of the sheets therethrough from an uppermost presented sheet to a bottom sheet of the array and folding back of at least a forward portion of the presented sheet onto said shelf member so the sheet may lie upon said shelf member with said cover in its closed position.

The invention further provides a method for sequentially dispensing individual, liquid-impregnated sheets from an interfolded array of the sheets while presenting a next available sheet from the array in a graspable position outside of a container. The method includes the steps of containing the array of sheets and withdrawing the sheets from the array along a dispensing direction. A surface of the sheets is contacted to direct the sheets along a curvilinear path which curves in a direction substantially perpendicular to the sheet surface while maintaining a cross-wise, transverse dimension of the sheets in a substantially linear, straight-line configuration. This draws an overlapping portion between a preceding sheet and a successive sheet along the curvilinear path to induce a separation of the individual sheets while presenting a portion of the successive sheet in the graspable position.

The dispensing apparatus of the invention advantageously provides a narrow, small sized exit opening which limits the evaporation of moisture from the stacked array of sheets. In addition, the dispensing apparatus can reliably dispense an individual sheet from the array which readily separates from the next successive sheet while presenting that successive sheet in a convenient, graspable position outside of the container. The individual sheets can be withdrawn in a substantially unwrinkled condition. As a result, the sheets can be readily presented in an open, extended condition while using a one-handed opera- tion.

BRIEF DESCRIPTION OF THE DRAWINGS

The invention will be more fully understood and further advantages will become apparent when reference is made to the following detailed description of the invention and the drawings, in which.

DETAILED DESCRIPTION OF THE INVENTION

Figure 1:
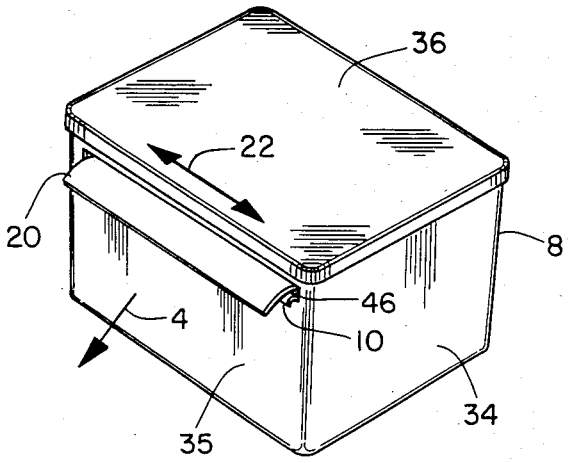
FIG. 1 representatively shows a perspective view of a dispensing package produced in accordance with the present invention.
Figure 2:
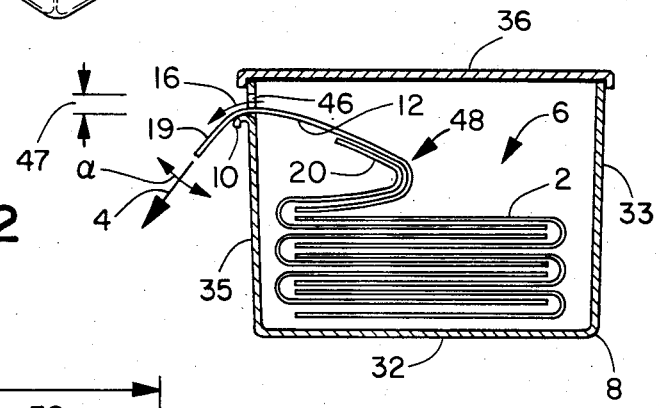
FIG. 2 representatively shows a sectional, side elevational view of the package of FIG. 1.
Figure 3:
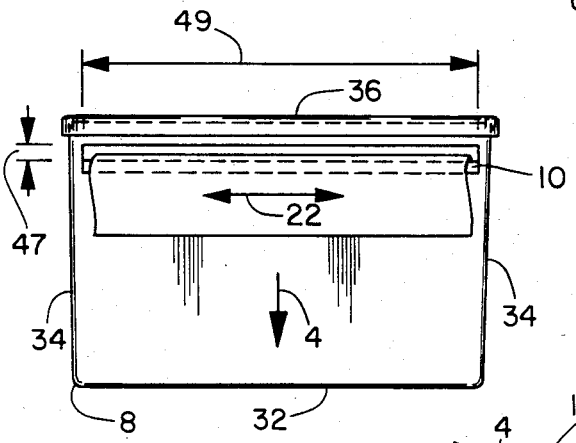
FIG. 3 representatively shows a front elevational view of the package of FIG. 1.

FIGS. 1-3 show a representative embodiment of the apparatus of the invention. The apparatus sequentially dispenses individual, liquid-impregnated sheets 2 along a dispensing direction 4 from an interfolded array 6 of the sheets while presenting a next available sheet 20 from the array in a graspable position. Container 8 has a volume sufficient for holding the array of sheets, and a transverse guiding means, such as edge member 10, is located on the container. Edge member 10 extends substantially linearly, in a substantially straight line, along a direction 22, which is transverse to dispensing direction 4. The edge member contacts a first major surface 12 of the sheets and directs the sheets along a curvilinear path 16, which curves in a direction substantially perpendicular to sheet surface 12. The guiding means thereby induces a separation between the individual sheets 2 and presents a portion of the next available sheet 20 in a graspable position outside of container 8. Sheet 20 is substantially unwrinkled.

Under normal conditions of use, it will be readily apparent that the dispensing direction will not be constant, but can instead vary each time a sheet is withdrawn from container 8. In the shown embodiment, the dispensing direction is essentially perpendicular to the container front wall surface, but can vary through the angle "alpha" representatively shown in FIG. 2. Although dispensing direction 4 may vary, it is readily apparent that the extending length of transverse edge member 10 remains essentially transverse or cross-wise with respect to the dispensing direction. Edge member 10 extends linearly into the plane of the drawing along a direction which is essentially perpendicular to dispensing direction 4.

In the illustrated embodiment of the invention, container 8 is a generally rectangular shaped box having a bottom 32, a back wall 33, two side walls 34, a front wall 35, a top wall 36 and an exit port 46 positioned in the front wall. The exit port has a width 47 and a length 49 which are sized to allow an essentially free and unrestricted passage of at least two overlapping sheets therethrough. Dimensionally, container 8 has a side-to-side width, a front-to-back length and a top-to-bottom height. The container is composed of a suitable liquid impermeable material, such as plastic, which is compatible and nonreactive with the liquid employed to impregnate sheets 2.

Figure 4:
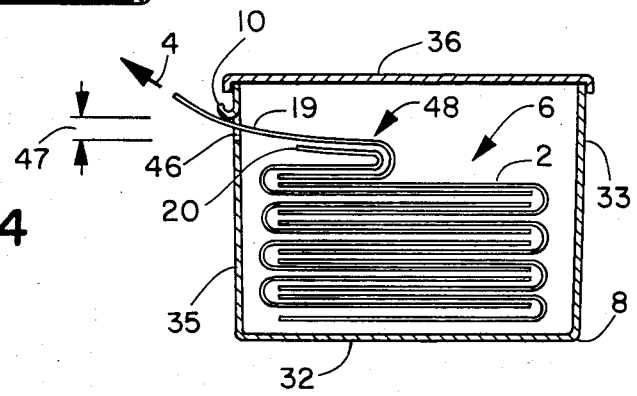
FIG. 4 representatively shows a sectional, side elevational view of another embodiment of the invention.

FIG. 4 illustrates another embodiment of the invention in which edge member 10 extends downwardly from the top of container 8. In this configuration, dispensing direction 4 is directed upwardly to ensure contact between edge member 10 and sheets 2.

Figure 5:
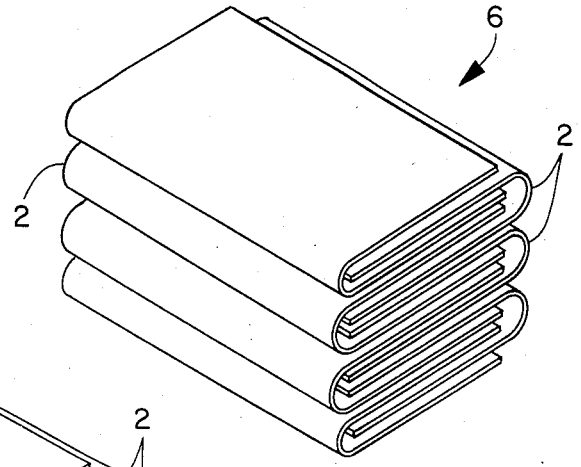
FIG. 5 representatively shows an array of sheets interfolded with a "V" type of fold.

The array 6 of interleaved or interfolded sheets is located within container 8 with the folded edges positioned adjacent to the front and back walls of the container. The substantially planar surfaces of the sheets are oriented approximately parallel to container bottom 32, and the individual sheets are sequentially withdrawn from the top of the stacked array of sheets. As illustrated in FIG. 5, the array of sheets may have a "V" type interfold. That is, the preceding sheet overlaps the adjacent, successive sheet over approximately ½ of the sheet length.

Figure 6:
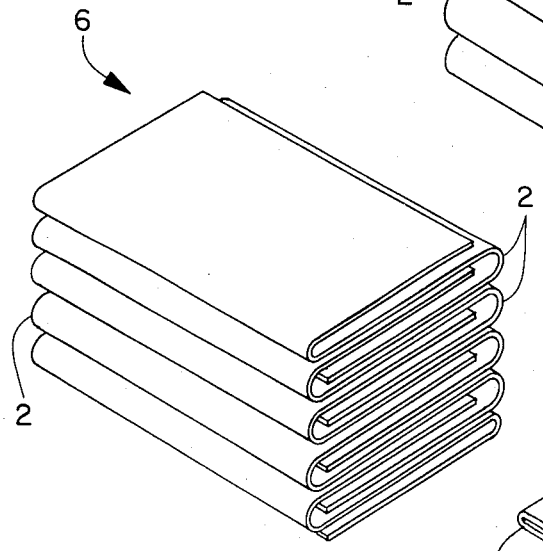
FIG. 6 representatively shows an array of sheets interfolded with a "Z" type of fold.

Alternatively, sheets 2 may be interleaved employing other types of folds. For example, a "Z" type interfold shown in FIG. 6, or even a "W" type interfold (not shown) could be employed. With the "Z" type interfold, approximately ⅓ of the length of adjacent sheets are overlapped. With the "W" type interfold, approximately ¼ of the length of adjacent sheets are overlapped.

Figure 7:
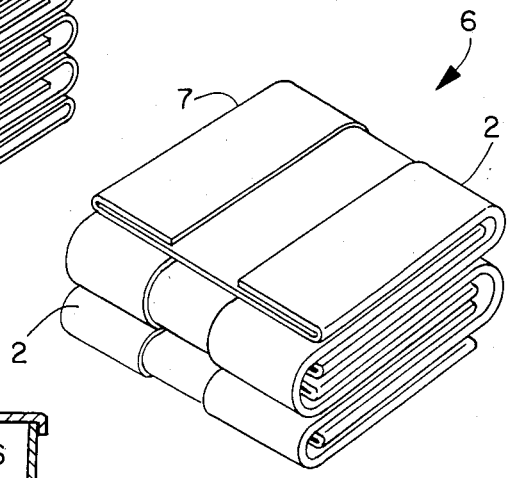
FIG. 7 representatively shows an array of sheets which are individually folded along lengthwise crease lines and then interfolded with a "V" type of fold.

In addition, sheets 2 may include longitudinal, lengthwise folds along longitudinal creases 7, as representatively shown in FIG. 7. These sheets are then interfolded, for example, with a "V" type interfold.

At the overlapping portions 48 of successive sheets, there is a certain amount of adhesion which is significantly increased by the moistened condition of the sheets. This adhesion allows the preceding sheet 19 being withdrawn to entrain the next successive sheet 20 and carry it toward and out through exit port 46. With the liquid impregnated or moistened sheets, however, it has been difficult to reliably break the adhesion between successive sheets to reliably dispense individual sheets one-at-a-time. As a result, a continuous stream of adhered sheets can be drawn out through exit port 46. To more reliably and effectively separate the withdrawn sheet 19 and leave or "present" a portion of the successive sheet 20 protruding out from the exit port in a graspable position, the present invention employs a distinctively configured guiding mechanism.

Figure 9:
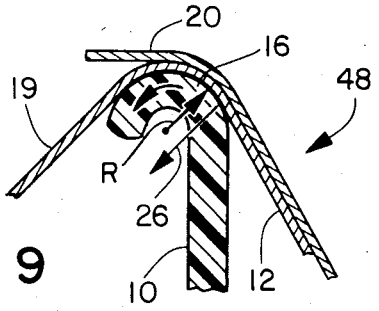
FIG. 9 representatively shows the effect of drawing the overlapping portion of the sheets around a curved edge member.

A guiding means, comprised of an initial transverse edge member 10, is positioned in front wall 35 and has a length dimension which extends substantially linearly in a straight line approximately parallel to the front edge of container bottom 32, transverse to dispensing direction 4, and along the width dimension of the container. In a particular embodiment of the invention, transverse edge member 10 extends approximately perpendicular to the dispensing direction, and has a substantially free edge which is convex on the outward surface thereof. The extending length dimension of the transverse edge member is equal to or greater than the width of sheets 2, and has a radiused edge. This radius can be formed by rounding off a distal free edge located in front wall 35, or by actually curling the free edge over inwardly or outwardly to form a curled, lip-type configuration, as illustrated in FIG. 9. The transverse edge member 10 is arranged to contact an adjacent, facing surface 12 of sheet 2 in a slideable engagement therewith. This arrangement guides and directs sheets 2 along a first curvilinear path 16 which curves to form surface 12 into a surface that is concave toward a direction 26 out of the plane of the sheet. The curvature direction 26 is oriented approximately perpendicular to sheet surface 12, and preferably, the radius of curvature R is ¼ in or less to provide improved effectiveness.

The process of pulling an initial preceding sheet 19 from container 8 draws the initial sheet around and in sliding contact with edge member 10 while maintaining a cross-wise, transverse dimension of the sheet in a substantially linear, straight line configuration. The initial sheet entrains the successive sheet 20 because of the adhesion between the sheets at overlapping portion 48, and draws the overlapping sheet portion around the curve defined by edge member 10. The motion of overlapping portion 48 around the curvilinear path induces a separation of the individual sheets 19 and 20, and consequently leaves the successive sheet behind, presented in a graspable position outside of container 8.

Figure 8:
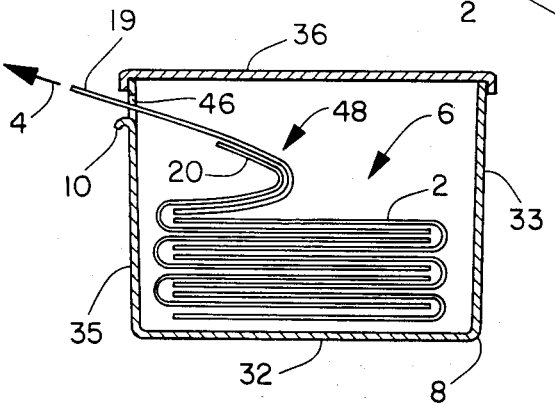
FIG. 8 representatively shows a situation where the overlapping portion of the sheets is not adequately drawn around the edge member of the package.

A reliable separation between the individual sheets can be produced as long as the overlapping portion 48 is drawn and curved around transverse edge member 10. As illustrated in FIG. 8, however, the overlapping portion of the sheets may not be adequately drawn around the edge member when the sheet is withdrawn from the container in a dispensing direction which operates to lift the overlapping portion 48 away from the edge member. Under such conditions, the two successive sheets may not reliably separate.

Figure 10:
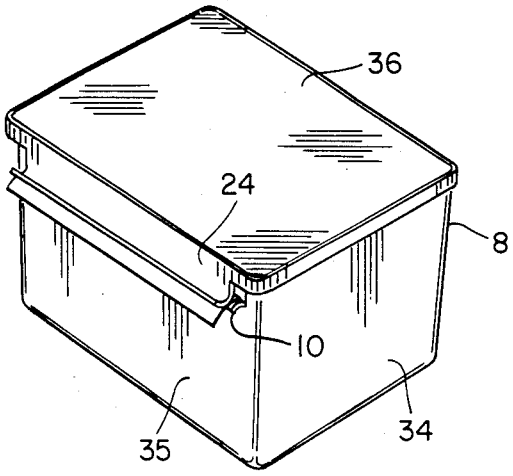
FIG. 10 representatively shows a perspective view of another embodiment of the invention having two curved edge members.
Figure 11:
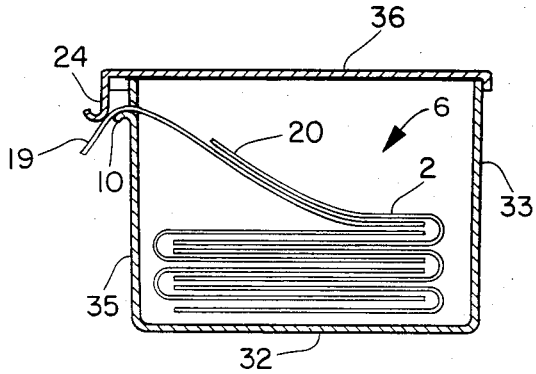
FIG. 11 representatively shows a cross-sectional, elevational view of the package shown in FIG. 10.
Figure 12:
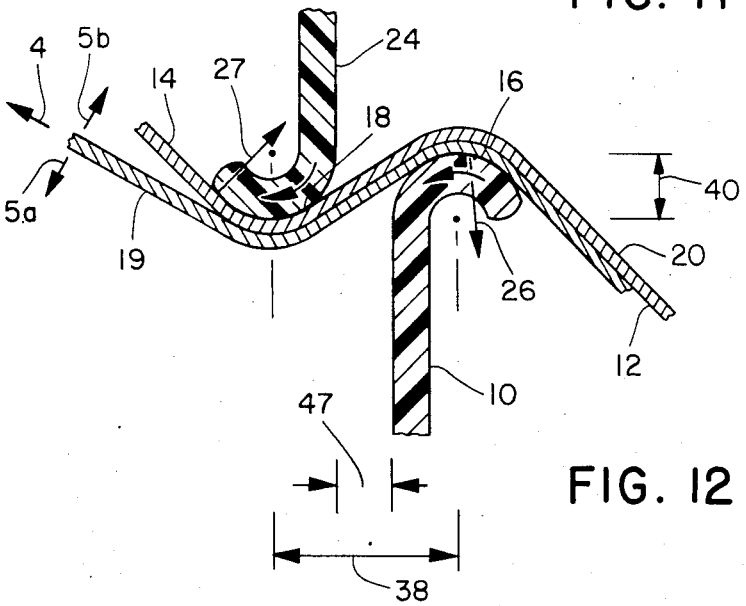
FIG. 12 representatively shows the effect of drawing the overlapping portion of these sheets around a series of two curved edge members.

To improve the operation of the dispensing device, the guiding means can include an offset guiding means, as illustrated in FIGS. 10–12. The offset guiding means is, for example, comprised of a vertically downward extending offset edge member 24. This offset edge member has a length dimension which extends substantially parallel to the initial transverse edge member 10, and has an open, free edge, which is located and arranged in an opposed, staggered relation with respect to transverse edge member 10. In particular, offset edge member 24 is offset from transverse edge member 10 by a discrete distance 38, measured approximately along dispensing direction 4, to produce an opposing, staggered relation between the two edge members. As illustrated in the figures, offset edge member 24 is positioned outwardly and further away from container 8 than is transverse edge member 10, and is constructed to slideably contact an opposite surface of sheets 2. That is, offset edge member 24 contacts sheet 2 on a major surface 14 opposite to the surface 12 contacted by transverse edge member 10. In addition, the offset edge member has an extending length dimension which is equal to or greater than the width dimension of the sheets.

The offset edge member directs sheets 2 along a second curvilinear path 18, which also curves out of the plane of the sheets but curves to form surface 14 into a surface that is concave toward a direction 27. Curvature direction 27 is generally opposite to the curvature direction 26 produced by transverse edge member 10. The offset edge member maintains the cross-wise transverse dimension of the sheets in a substantially linear, straight-line configuration and has a radiused edge which is convex on an outward and downwardly extending distal edge portion thereof. This edge can be radiused by rounding off the edge or by actually curling the edge over to form a curled, lip-type configuration. The radius of curvature of the edge is preferably not more than about ¼ in to provide improved performance.

In the particular aspect of the invention wherein exit opening 46 is located at the front wall of container 8 when the container is positioned for use, transverse edge member 10 has an upwardly oriented edge. This edge is relatively inwardly located such that it is the first most guiding means approached and contacted by the advancing sheets. In addition, transverse edge member 10 is located a distance above the upper most sheet in stacked array 6. Offset edge member 24 has a downwardly oriented edge which is located outwardly with respect to transverse edge member 10. As a result, the offset edge member is the second most guiding means approached and contacted by the advancing sheets 2. This configuration essentially ensures that a second successive sheet 20 entrained by the preceding sheet 19 being withdrawn will be contacted against and slid over at least one guiding edge member; either transverse edge member 10 or offset edge member 24. More particularly, the overlapping portion 48 of the two sheets will be curved around at least one of the guiding edge members.

As the overlapping sheet portion moves around the edge member, the leading portion of the entrained sheet 20 will pass over and curve around the edge member. The process of turning about the edge member acts to reduce the adhesion between the withdrawn preceding sheet 19 and the successive sheet 20. While not intending to be bound by any particular theory, it is believed that the edge member creates a peeling force or shearing force or both which reduces the inter-sheet adhesion and more readily allows the successive sheet to separate. Surprisingly, even though the overlapped section of the successive sheet 20 is located "underneath" the preceding withdrawn sheet 19 at the overlapping sheet portion 48, and the successive sheet is pressed between preceding sheet 19 and the edge member, the sheets still separate to leave a leading portion of sheet 20 presented outside of exit port 46 for subsequent grasping.

In another aspect of the invention, the transverse guiding means and the offset guiding means can be positioned in an overlapped configuration, as representatively shown in FIG. 12. For improved effectiveness, offset edge member 24 is positioned with its convex edge oriented downward and located more outwardly and away from container 8 when compared to transverse edge member 10. However, the relative positions of transverse edge member 10 and offset edge member 24 may be reversed if desired. Using as a reference a line extending approximately perpendicular to the front wall of container 8, transverse edge member 10 and offset edge member 24 have a discrete amount of edge member overlap 40. The effective amount of the edge member overlap decreases as the dispensing direction is angled downwardly in a direction 5*a* and increases as the dispensing direction is angled upwardly in a direction 5*b*. Since during ordinary use the dispensing direction is generally upwardly directed, the effective edge member overlap is readily maintained when employing the illustrated configuration.

The configuration comprised of overlapped edge members can direct and draw sheets 2 along a generally S-shaped, zig-zag path. This serpentine-type path advantageously subjects the sheets to a distinctive reversing type curvature that can increase the ability of the withdrawn, preceding sheet to separate from the next successive sheet. During at least one of the curving turns through the zig-zag path, the overlapping portion of the successive sheet 20 overlies both the preceding sheet 19 and the particular edge member contacting the preceding sheet. As a result, the leading edge of successive sheet 20 tends to continue along a path tangential to the curvature of the contacting edge member because of an inherent stiffness of the sheet material. This situation generates a peeling action that helps break the adhesion between the two sheets. Even though the next path curvature may act to press the two sheets back together, the separation tendency produced by the initial peeling action can still increase the separation ability of the overlapping sheets.

Figure 13:
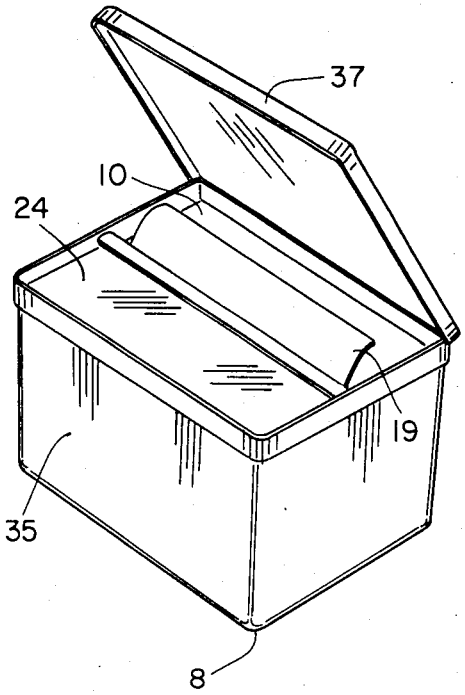
FIG. 13 representatively shows a perspective view of another embodiment of the invention having an outlet opening on the top of the container.
Figure 14:
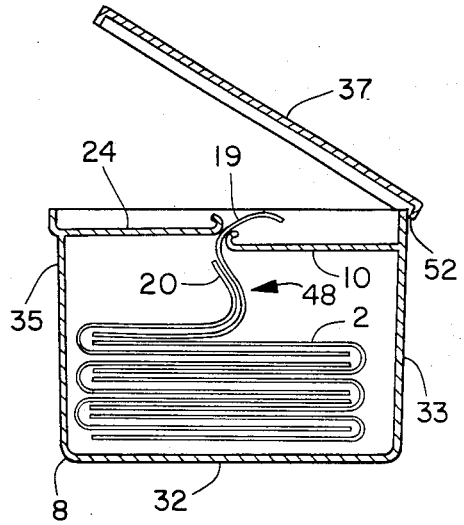
FIG. 14 representatively shows a sectional, side elevational view of the package of FIG. 13.
Figure 15:
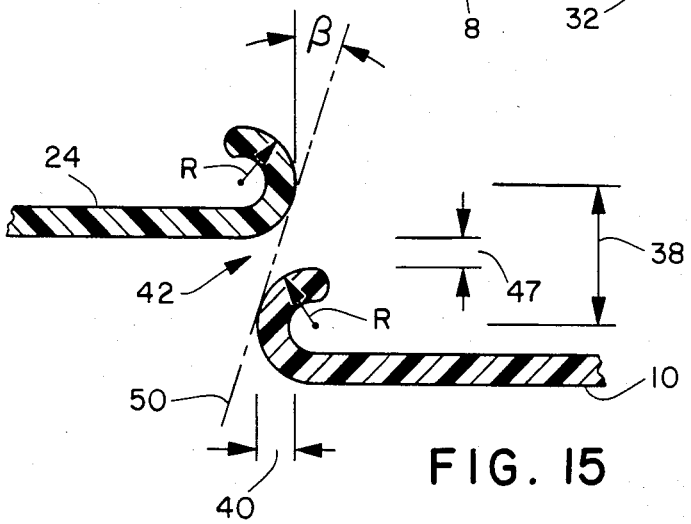
FIG. 15 representatively shows a detailed, sectional side elevational view of the two curved edge members employed in the package shown in FIG. 13.

A further embodiment of the invention representatively shown in FIGS. 13–15 has an exit port 42 located at the top of container 8. In this configuration, transverse edge member 10 connects to rear wall 33, spans the cross-wise width dimension of the container, and extends toward front wall 35 in a position approximately parallel to container bottom 32. The distal free edge of the transverse edge member has its convex portion facing toward the container front wall. Offset edge member 24 connects to container front wall 35, spans the cross-wise width of container 8 and extends toward back wall 33. The distal free edge of offset edge member 24 has a convex surface portion facing the container back wall and positioned in an opposing, staggered relation with respect to the convex surface of transverse edge member 10. While offset edge member 24 may be positioned lower than transverse edge member 10 within container 8, the offset edge member is preferably positioned higher than the transverse edge member (measured relative to container bottom 32) to provide improved performance.

In the embodiment shown, offset edge member 24 and transverse edge member 10 are staggered, one above the other, by the distance 38 and are spaced apart from each other to provide an exit port gap 42. This gap has an edge-to-edge width dimension 47 greater than the thickness of the overlapping portion of two sheets, and has an end-to-end length of not less than the width of the sheets.

Referring to FIG. 15, a tangent line 50 can be drawn such that it tangentially and simultaneously contacts both transverse edge member 10 and offset edge member 24. For improved effectiveness, the edge members overlap by the distance 40 such that the outwardly extending portion of tangent line 50 tilts backs toward the rear of container 8 and lid 37 at an angle "beta", which can be within the range of 0°-90°. This arrangement in conjunction with a lid 37 hinged at back wall 33 helps to ensure that the dispensing direction will generally be angled toward the container front wall and that the sheets will be drawn over a zig-zag path over transverse edge member 10 and offset edge member 24.

Lid or cover member 37 connects to container back wall 33 along hinge line 52. This cover is constructed to provide an effective seal over and around the top of container 8 to minimize leakage and evaporation of the liquid from the container and the exposed, presented sheet. For example, cover 37 can be constructed to form a snap-type seal over the top of the container employing conventional techniques and structures well known in the art.

While the shown embodiment of the invention employs a rectangular box container, it is readily apparent that other container configurations could also be employed. For example, the container may be round, oval, or in a polygonal shape other than the shown rectangular shape.

Various materials are suitable for constructing the device of the invention. The material should be impervious to the liquid employed to impregnate the sheets, and should have sufficient strength to withstand the stresses of transport and ordinary use. The walls of container 8 may be flexible and pliable if desired. The guiding means, however, should be configured to be sufficiently rigid to resist any significant bending or bowing thereof when the sheets are drawn over the contacting surfaces of the guiding means. In particular, there should be no bowing of a magnitude sufficient to cause excessive longitudinal wrinkles along the length of the string of sheets. Such wrinkles could inhibit the reliable separation between the overlapped sheets.

Figure 16:
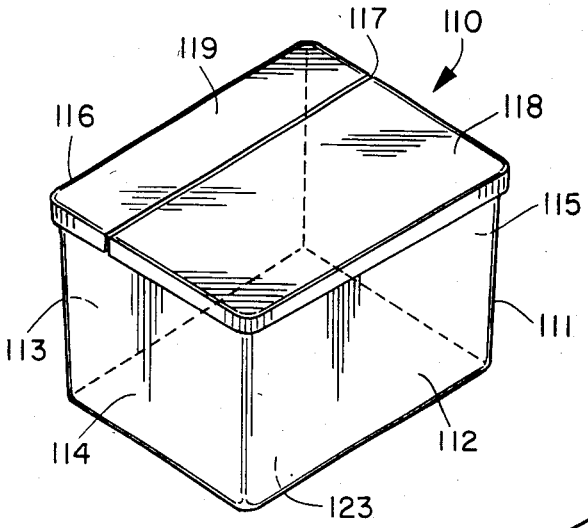
FIG. 16 is a perspective view of a dispensing package according to the present invention.

Referring again to the drawings, FIG. 16 shows a perspective view of a particular embodiment of a dispensing package configured according to the invention. Such a package may usefully be employed to contain a stacked array of discrete folded, interleaved moistened sheets dispensable so that withdrawal of a single presented sheet from the package will cause it to carry a next successive sheet in the array into dispensing position.

The dispensing package 110 comprises a container 111 having a floor 123 and upstanding front wall 112, back wall 113 and side walls 114, 115 jointed at their lower edges to the floor 123 to form a box-like retaining structure defining an approximately rectangular enclosed volume. As used herein and in the claims, "approximately rectangular" includes a volume which is a cube, a rectangular volume or a frusto-pyramidal volume or the like. Obviously, the container could be other than a four-sided structure, including any polygonal structure, cylindrical, oval or the like. For example, although the front, back and side walls, as well as the floor, may each be substantially planar, as shown, it is within the purview of the invention to vary the container construction such that one or more walls is of non-planar configuration, e.g., arcuate in shape.

The dispensing package includes a cover 116 as a closure means for the container 111, disposed at upper edges of the front, back and side walls of the container. The cover is transversely hinged along a hinge line 117, with the cover posterior to the hinge line, i.e., in the rear section 119, being affixed to the back and side walls in contact at their upper ends with such section of the cover. Anterior to the transverse hinge line 117, the front section 118 of cover 116 is openable from a closed position, as in FIG. 16, in contact with the front and side walls, to an open position defining a dispenser opening, such as in FIG. 17. The container 111 thus defines an enclosed volume for retention of the array of sheets therein.

Figure 17:
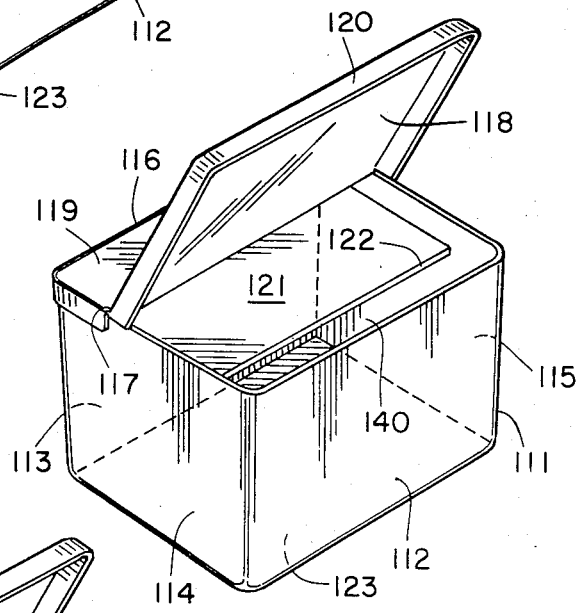
FIG. 17 is a perspective view of the dispensing package of FIG. 16, showing the hingedly segmented cover being opened as in use.
Figure 18:
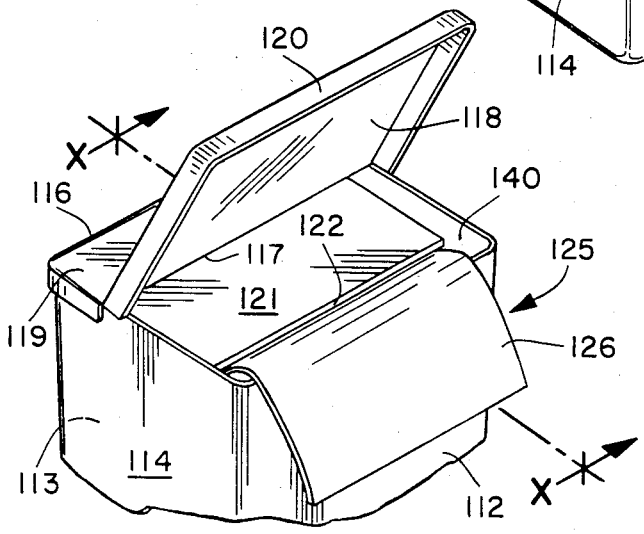
FIG. 18 is a perspective view of the dispensing package of FIGS. 16 and 17, containing a stacked array of discrete folded, interleaved moistened sheets.
Figure 19:
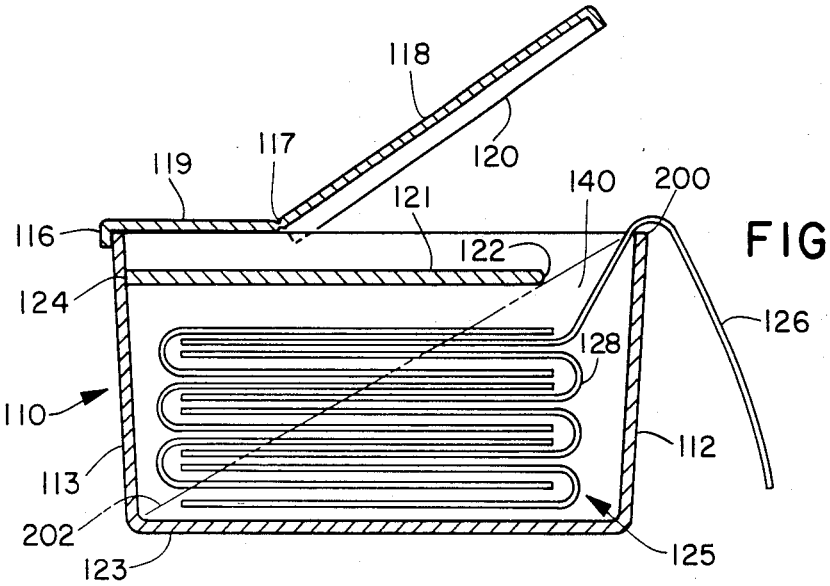
FIG. 19 is a sectional elevational view of the dispensing package of FIG. 18, taken along line x—x and showing the details of construction thereof.

In the embodiment representatively shown in FIG. 17, shelf member 121 is mounted on the container 111 within the enclosed volume thereof, extending transversely between the side walls 114, 115 and extending from the back wall 113 toward the front wall 112. The shelf member has a front edge 122 in spaced relationship to the front wall 112, whereby the front edge is disposed adjacent to the dispenser opening 140 with the front edge delimiting a transversely extending front opening 140 for sequential withdrawal of the sheets therethrough. This withdrawal begins with uppermost presented sheet 126 and continued to the bottom sheet of the stacked array 125 (FIG. 19). The shelf member can be joined at its rear edge 124 to the rear wall 113, by any suitable means, such as adhesive bonding, ultrasonic welding, integral forming, etc., and is located in vertically spaced relationship to the floor 123. In this manner, a stacked array 125 of discrete folded, interleaved moistened sheets, 126, 127, 128, etc., are sequentially dispensable so that withdrawal of a single presented sheet 126 from the package will cause it to carry the next successive sheet 127 in the array 125 into dispensing position, through the front opening 140, as shown in FIGS. 18 and 19.

Figure 20:
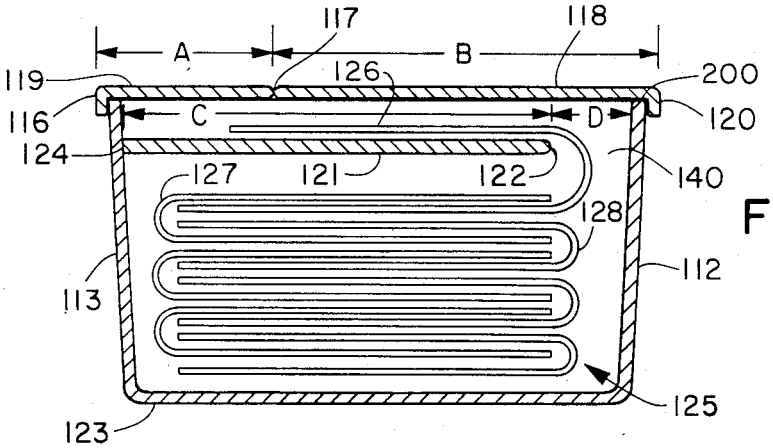
FIG. 20 is a sectional elevational view of the container of FIG. 19, with the cover in closed position.

Thus, the presented sheet 126 has a forward portion extending through the opening 140 which, as shown in FIG. 20, may be folded back to lie on the shelf member 121 when the cover 116 is closed. In the closed position, the front section 118 of the cover is disposed in closure contact with the upper edges of the front and side walls.

Figure 21:
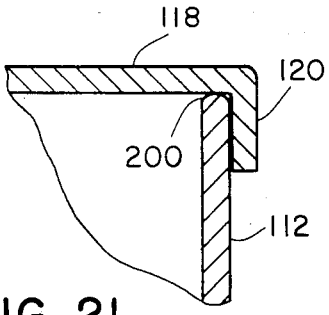
FIG. 21 is a sectional elevational view of a portion of the cover and front wall of the dispensing package, showing the details of the closure means.

FIG. 21 shows the details of a suitable closure arrangement for the cover 116, wherein the cover has a downwardly extending flange portion 120 at its front edge which closingly mates with the upper segment of the front wall 112. The length of the front section 118 of the cover 116 may be such that the flange portion 120 of the cover 116 forms a snap-fit which places the cover under tension from its front edge to its rear edge, thereby providing a leak-tight fit of the cover to the enclosure.

Figure 22:
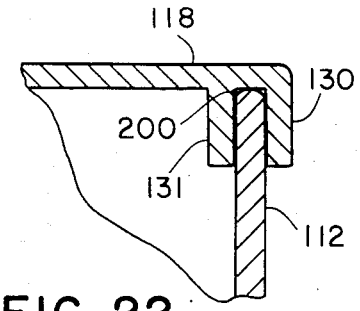
FIG. 22 is a sectional elevational view of a portion of the cover and front wall of the dispensing container, showing another closure arrangement.

Alternatively, a closure arrangement such as that shown in FIG. 22 may be employed, wherein the front section 118 of the cover 116 has dual downwardly extending flange portions 130, 131 at its front edge. The respective flanges 130 and 131 are in laterally spaced relationship to one another to provide a groove (unnumbered) therebetween which receives the upper end of the front wall when the cover is closed. Again, the length of the front section 118 of the cover 116 may be proportioned such that the dual flange couples with the upper end of the front wall 112 to place the cover under tension, thereby providing a leak-tight fit to retain moisture in the container.

As shown in the representative embodiment illustrated by FIG. 20, transverse hinge line 117 may be disposed at a point closure to the rear of the cover than to the front, i.e., such that the distance B of the front section of the cover is greater than the dimension A of the rear section thereof. Such criterion provides for the front section of the cover to have a greater areal extent than the rear section of the cover, so as to provide an opening when the cover is opened by swinging front section 118 upwardly about the transverse hinge line 117, to permit ready access by the user to the presented sheet 126 of the array 125. Thus, the sheet presents a large area to the user upon opening of the front section of the cover, thereby facilitating the withdrawal of same from the container to initiate sequential dispensing of sheets from the array 125. In a particular aspect of the invention, the dimension B/(A+B) is from about 0.5–0.8.

It will be appreciated, however, that in contrast to the embodiment illustrated by FIGS. 16–20, wherein the transverse hinge line is located on the cover between the front and rear walls of the container, it may be advantageous in some instances to locate the transverse hinge line at the rear wall of the container or even behind the rear wall of the container. Such positioning of the hinge allows the cover and shelf member to be produced in one piece employing conventional thermal die stamping techniques, thereby simplifying the manufacture and assembly of the dispensing package.

As also shown in FIG. 20, the shelf has a front-to-back dimension C, as measured along the shelf member from the front edge 122 to the rear edge 124 thereof, which is a major portion of the straight-line distance C+D from the front wall 112 to the rear wall 113 at the vertical height of the shelf member. Preferably, the quantity C/(C+D) is from about 0.5–0.95, and more preferably is from about 0.7–0.9. Most preferably, the front edge 122 of shelf member 121 intersects an imaginary line 202, as shown in FIG. 19, which extends from the bottom edge of the back wall 113 of the container to the top edge 200 of the front wall of the container; such configuration forces the string of dispensed sheets to follow a curvilinear path regardless of the withdrawal angle of the uppermost presented sheet. Such curvilinear, S-shaped path over the front edge 122 of the shelf member 121 and over the top edge 200 of the front wall 112 produces a highly desirable peeling and shearing action which facilitates a clean separation between the adjacent sheets, particularly where the sequential sheets are highly saturated with moisture. Such saturation produces a high degree of cohesion between the adjacent sheets, which in the absence of a curvilinear dispensing path may cause the sheets to continue out of the container in a continuous stream.

In a preferred aspect of the present invention, the front edge 122 of shelf member 121 and the top edge 200 of front wall 112 of the container are rounded in character, each having a radius of curvature not exceeding about ⅛ inch. This feature is particularly advantageous in connection with the aforementioned provision of a curvilinear dispensing path for sheets from the container, where the front edge of the shelf member and top edge of the front wall are utilized to assist in peeling and shearing separation of adjacent sheets during the dispensing operation. In such instance, the provision of radii of curvature above about ⅛ inch for these shelf and front wall edges decreases the level of peeling and shearing imparted to the sheets, and decreases the ability of these surfaces to separate successive sheets during dispensing.

As a related feature, it is preferred in the practice of the present invention that the front edge 122 of shelf member 121 and the top edge 200 of front wall 112 each is sufficiently rigid so that they do not significantly bow or bend when the sheets are drawn through opening 140, but instead, remain substantially straight during the dispensing use of the container. If these edges become bowed or bent during dispensing, the dispensed sheets may develop longitudinal wrinkles along the length of the sheet string, and such wrinkles may adversely effect the separation between successive sheets in the string. The other components of the container may be rigid, soft or flexible, as is desired for a given container or dispensing application. By way of example, the container may be formed from a flexible material except for a rigid front wall edge and a rigid front edge for the shelf member.

The array 125 of discrete folded, interleaved moistened sheets 126, 127, 128, etc., may be interleaved with the individual sheets, as is shown in FIGS. 19 and 20. The sheets have a "V"-shaped fold profile when viewed, as in FIG. 20, in cross-sectional elevational view. Alternatively, the sheets may be folded with a "W" profile, or a "Z"-shaped profile, when viewed in cross-sectional elevational view corresponding to the view of FIGS. 19 and 20. The sheets may also be folded in any other manner whereby the folded interleaved sheets form a stacked array wherein a withdrawal of a single presented sheet (for example, the top or uppermost sheet) from the stacked array through the opening 140 in the package 110 will cause the withdrawn sheet to carry a next successive sheet in the array into dispensing position. The sheets could alternatively be connected to each other by perforated sections to facilitate tearing off individual sections as discrete sheets.

It will be appreciated that the amount of overlap between successive sheets in the stacked array will depend on the folding configuration of the respective sheets. Specifically, the amount of the next succeeding sheet pulled out through the dispensing opening will be approximately equal to the amount of actual overlap between the successive sheets in the stacked array. For example, a V-fold with a half-sheet overlap would present approximately one-half of the next succeeding sheet. A W-fold with one-fourth sheet overlap is also possible and this configuration would present about one-fourth of the next succeeding sheet when a preceding sheet is withdrawn from the container. A Z-fold typically will have approximately one-third sheet overlap, and such folding configuration would present about one-third of a next succeeding sheet when a preceding sheet is withdrawn from the container.

The container 111 and cover 116 may be formed of any suitable material, such as plastics or polymerics, e.g., polypropylene, polyvinylchloride, or other suitable materials of construction. During manufacture, the package may be provided with a fluid-impermeable liner, such as a plastic film or metal foil, across the upper end of the front, back and side walls. This liner provides a moisture barrier and seal for the package in a conventional manner. The stacked array is suitably disposed in the interior volume of the container beneath the shelf member 121 with a starter sheet or uppermost sheet in the array being projected through the opening 140 and laid back onto the shelf member's upper surface, as is shown in FIG. 20.

Figure 23:
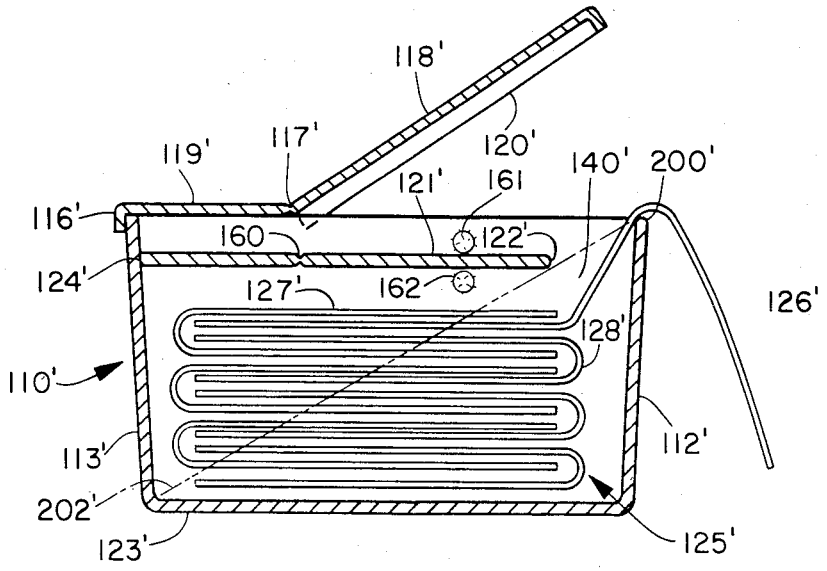
FIG. 23 is a sectional elevational view of an alternative embodiment of the dispensing package, showing the details of construction thereof.

FIG. 23 shows another representative embodiment of the present invention, wherein all parts and elements are numbered correspondingly with respect to FIG. 23, but with the reference numerals suffixed by a prime designation. In this embodiment, the shelf member 121' has an intermediate transverse hinge line 160 between its front edge 122' and its rear edge 124' attached to rear wall 113'. Such hinged construction permits the stacked array of sheets 125' to be initially packed and/or subsequently stored without protrusion of a sheet through the dispensing opening 140' and lay-back on the top surface of the shelf member 121'. In such construction, the user can swing the forward portion of the shelf member upwardly and rearwardly with reference to the hinge line, to reach the uppermost sheet in the stacked array beneath the shelf member and thereupon initiate the withdrawal sequence. After positioning the first sheet outside the dispensing opening 140', the front section of the shelf member may be swung forwardly and downwardly into position for retention by means of the dimples 161 and 162 in the respective sidewalls of the container. Thus, the sidewalls are formed with inwardly extending protrusions, such as may be formed by simple stamping or molding operations, to present a spaced-apart array of convex dimple surfaces on the inside wall surface of the container, which removably retain the front section of the shelf member in position.

As is apparent from the foregoing, the dispensing package of the present invention provides a delivery or dispensing location at the front region of the container and delivers approximately a half sheet of a second, following sheet in the array through the shelf member opening 140 when a first sheet is dispensed. Such half of a following sheet is delivered in a manner that results in its hanging over the front wall of the container as shown in FIG. 19, for easy access even when the front section 118 of the cover 116 is nearly closed, and the extended half portion of the thus presented sheet is readily folded back onto the shelf member 121 for repose thereon, under the closed cover, between usages of the dispensing package. Thus, the cover may be closed, for example to prevent contamination of the contents or evaporation of the liquid used to moisten the sheets. The container of the invention is thus well suited for use in dispensing medicated sheets or sheets impregnated with a cleanser or emollient or other treating substance, such as sheets or pads used for health, beauty and/or infant care.

Having thus described the invention in rather full detail, it will be readily apparent that various changes and modifications may be made without departing from the spirit of the invention. All of such changes or modifications are contemplated as being within the scope of the invention as defined by the subjoined claims.

We claim:

1. An apparatus for sequentially dispensing individual, liquid-impregnated sheets along a dispensing direction from an interfolded array of said sheets while presenting a next available sheet from said array in a graspable position, comprising:

a. a container for holding said array of sheets, said container including a cover which provides an effective seal thereon;

b. guiding means, located in said container, for contacting a major surface of said sheets to direct said sheets along a curvilinear path, thereby inducing a separation between said individual sheets and the presenting of said next available sheet in said graspable position outside of said container, wherein said guiding means comprises, (i) transverse guiding means located on said container and extending substantially linearly along a direction transverse to said dispensing direction for contacting a surface of said sheet to direct said sheets along a first curvilinear path which curves in a direction substantially perpendicular to said sheet surface, and (ii) offset guiding means extending substantially parallel to said first guiding means and arranged in an opposing, staggered relation therewith, for contacting an opposite surface of said sheets to direct said sheets along a second curvilinear path, which curves in a direction substantially perpendicular to said opposite sheet surface with a curvature direction generally opposite to the curvature direction produced by the transverse guiding means, said offset guiding means being transversely hinged to allow a user to move said offset guiding means with reference to said hinge to reach an uppermost sheet in the stacked array.

2. An apparatus as recited in claim 1, wherein said guiding means is located at the top of said container to provide a shelf member which allows at least a forward portion of the presented sheet to lie there upon when said cover is in a closed postion, said container includes a front wall, a back wall, and side walls, and said cover is disposed at upper edges of the container front, back and side walls, and is constructed to provide an effective seal over the top of said container.

3. An apparatus as recited in claim 1, wherein said transverse guiding means and said offset guiding means have length dimensions which are equal to or greater than the width dimension of said sheets.

4. An apparatus as recited in claim 1, wherein said transverse guiding means extends substantially perpendicular to said dispensing direction.

5. An apparatus as recited in claim 1, wherein said transverse guiding means contacts said sheet surface along a radiused edge contour.

6. An apparatus as recited in claim 5, wherein the radiused edge contour of said transverse guiding means has a radius of not more than about ¼ in.

7. An apparatus as recited in claim 1, wherein said offset guiding means has a radiused edge contour that contacts said opposite sheet surface.

8. An apparatus as recited in claim 7, wherein the radiused edge contour of said offset guiding means has a radius of not more than about ¼ in.

9. An apparatus as recited in claim 1, wherein said transverse guiding means and said offset guiding means are constructed and arranged to direct said sheets along a substantially S-shaped path which curves in directions essentially perpendicular to the surface of said sheets.

10. A method for sequentially dispensing individual liquid-impregnated sheets from an interfolded array of said sheets while presenting a next available sheet from said array in a graspable position outside of a container, comprising the steps of:

a. holding said array of sheets in the container;

b. transversely hinging within the container a guide means, which is capable of being moved with reference to a hinge to allow a user to reach an uppermost sheet in the stacked array;

c. withdrawing said sheets from said array along a dispensing direction;

d. contacting a first surface of said sheets with said guide means to direct said sheets along a first curvilinear path which curves in a direction substantially perpendicular to said first sheet surface while maintaining the cross-wise, transverse dimension of said sheets in a substantially linear, straight-line configuration; and e. contacting an opposite surface of said sheets to direct said sheets along a second curvilinear path, which curves in a curvature direction that is generally opposite to the curvature direction of said first curvilinear path, while maintaining the cross-wise, transverse dimension of said sheets in a substantially linear, straight-line configuration, thereby drawing an overlapping portion between a preceding sheet and a next successive sheet along a generally zig-zag path to induce a separation of the individual sheets and present said successive sheet in said graspable position.

11. A dispensing package for a stacked array of discrete folded, interleaved moistened sheets dispensable so that withdrawal of a single presented sheet from the package will cause it to carry a next successive sheet in the array into dispensing position, comprising:

a. a container having a floor and upstanding front, back and side walls to define an enclosed volume for retention of said array of sheets therein;

b. a cover for said container disposed at upper edges of the front, back and side walls thereof, said cover being transversely hinged and affixed to said back wall, and being openable from a closed position in contact with said front and side walls and closable thereto from an open position; and c. a shelf member mounted on said container within said enclosed volume of said container in vertically spaced relationship from said floor and from the upper edge of the container front wall, wherein said shelf member intersects an imaginary line extending from a bottom edge of the container back wall to the upper edge of the container front wall, said shelf member extends transversely between said side walls from said back wall toward said front wall to a front edge in spaced relationship to said front wall to define a transversely extending front opening for sequential withdrawing of said sheets therethrough from an uppermost presented sheet to a bottom sheet of said array, said shelf member allows a folding back of at least a forward portion of the presented sheet onto said shelf member so the sheet may lie upon said shelf member with said cover in its closed position, and said shelf member is transversely hinged to allow a user to move said shelf member with reference to said hinge to reach the uppermost sheet in the stacked array.

12. A dispensing package as recited in claim 11, wherein a front edge of said shelf member and the top edge of said container front wall are rounded with a radius of curvature not exceeding about $\frac{1}{8}$ inch.

13. A dispensing package containing a stacked array of discrete folded, interleaved moistened sheets dispensable so that withdrawal of a single presented sheet from the package will cause it to carry a next successive in the array into dispensing position, comprising:

a. a container having a floor and upstanding front, back and side walls to define an enclosed volume for retention of said array of sheets therein;

b. a cover for said container disposed at upper edges of the front, back and side walls thereof, said cover being transversely hinged and affixed to said back wall, and being openable from a closed position in contact with said front and side walls and closable thereto from an open position; and c. a shelf member mounted on said container within said enclosed volume of said container in vertically spaced relationship from said floor and from the upper edge of the container front wall, wherein said shelf member is transversely hinged to allow a user to move said shelf member with reference to said hinge to reach an uppermost sheet in the stacked array, said shelf member extends transversely between said side walls from said back wall toward said front wall to front edge in spaced relationship to said front wall to define a transversely extending front opening for sequential withdrawing of said sheets therethrough from an uppermost presented sheet to a bottom sheet of said array, and said shelf member allows a folding back of at least a forward portion of the presented sheet onto said shelf member so the sheet may lie upon said shelf member with said cover in its closed position.

14. A dispensing package according to claim 13, containing a stacked array of sheets.

15. A dispensing package according to claim 13, wherein said container comprises upstanding wall means and said closure means surmounts the wall means and comprises a cover for said container.

16. A dispensing package according to claim 13, wherein said cover is transversely hinged along a line dividing said cover into a rear portion posterior thereto and a front portion anterior thereto, and wherein said front portion is of greater areal extent than said rear portion.

17. A dispensing package according to claim 16, wherein said front portion of said cover has a downwardly oriented flange extension at its side and front edges mating cooperatively with the upper edges of said side and front walls in register therewith when said cover is in said closed position.

* * * * *